US005255531A

United States Patent [19]

Williams et al.

[11] Patent Number: 5,255,531

[45] Date of Patent: Oct. 26, 1993

[54] REFRIGERATOR MULLION ASSEMBLY WITH HOT GAS DEFROST TUBE

[75] Inventors: Stephen G. Williams; Michael W. Greenwood, both of Ohio Township, Warrick County, Ind.

[73] Assignee: Whirlpool Corporation, Benton Harbor, Mich.

[21] Appl. No.: 769

[22] Filed: Jan. 5, 1993

[51] Int. Cl.[5] ..... F25B 47/00

[52] U.S. Cl. ..... 62/277; 312/406; 312/406.2

[58] Field of Search ..... 62/277, 278; 49/402; 312/406.1, 406, 405, 406.2

[56] References Cited

U.S. PATENT DOCUMENTS 3,835,660 9/1974 Franck ..... 62/277

4,884,415 12/1989 Mandel ..... 62/277

*Primary Examiner*—John M. Sollecito

*Attorney, Agent, or Firm*—Thomas J. Roth; Stephen D. Krefman; Thomas E. Turcotte

[57] ABSTRACT

A mullion assembly includes a mullion rail and hot gas tube for preventing condensation on the mullion of a refrigerator/freezer. The mullion rail is rollformed of steel and includes complementary channels for retaining refrigerator and freezer liners. One of the channels includes an additional formed portion to accept and positively retain a hot gas tube in surface contact with a rear surface of a front wall of the mullion rail to provide acceptable heat transfer from the tube to the steel along the entire length of the mullion rail.

12 Claims, 2 Drawing Sheets

REFRIGERATOR MULLION ASSEMBLY WITH HOT GAS DEFROST TUBE

FIELD OF THE INVENTION

This invention relates to refrigeration apparatus cabinet structure and, more particularly, to an improved heated mullion assembly.

BACKGROUND OF THE INVENTION

A side-by-side refrigerator/freezer is produced with two separate thermoformed plastic liners in the form of tubs. One liner is for the freezer compartment. The other liner is for the refrigerator compartment. The liners are foamed-in-place, housed in a pre-painted steel shell and having a center vertical divider commonly referred to as a mullion rail.

Under high temperature or humidity conditions condensation may form on the front flange surface of the metal shell and the mullion rail owing to the relatively low temperature in the refrigerated compartments. To minimize any such condensation, manufacturers conventionally provide anti-sweat heaters in the flange area surrounding the refrigerated compartments, and the mullion rail. The heaters conventionally provided for such anti-sweat or anti-condensation function are relatively low wattage heaters so as to minimize energy loss in eliminating condensation of moisture on the exposed wall surfaces. Alternative designs use a conduit or tube connected in the sealed refrigeration system to conduct hot refrigeration gases. The use of such a tube requires that additional hardware be included to install the same, which adds to both part count and assembly labor.

The present invention is intended to overcome the problems discussed above in a novel and simple manner.

SUMMARY OF THE INVENTION

In accordance with the invention there is disclosed an improved heated mullion assembly including a mullion rail having a channel which positively retains a hot gas tube in surface contact with a rear surface of the mullion rail to reduce condensation on the mullion rail.

Broadly, there is disclosed herein a refrigeration apparatus cabinet including an outer shell having a front flange defining a rectangular opening. First and second liners are in juxtaposed relation in the shell defining first and second storage compartments, respectively. Each liner includes a generally rectangular, front peripheral flange with one side of each flange being adjacent one another. An improved heated mullion assembly comprises an elongate conduit, the conduit carrying heating means for preventing condensation. A mullion rail comprises an elongate plate defining a centerline and opposite first and second longitudinal edges. The plate has a first reverse bend between the centerline and first longitudinal edge to define a first channel. A second reverse bend is between the centerline and the second longitudinal edge to define a second channel opening in a direction facing the first channel. A third reverse bend is between the first reverse bend and the first longitudinal edge to define a third channel opening opposite the first channel. A fourth reverse bend is between the second reverse bend and the second longitudinal edge to define a fourth channel opening opposite the third channel. The third and fourth channels each receive the one flange of one of the liners. The plate includes a formed portion between the first and third reverse bends adapted to provide a surface complementary to the conduit and spaced a select distance from a front wall rear surface less than the thickness of the conduit to positively retain the conduit in the first channel in surface contact with the front wall rear surface to prevent condensation on the mullion rail.

It is a feature of the invention that the conduit comprises a tube and the heating means comprises a hot refrigerated gas circulated therethrough.

It is another feature of the invention that the mullion rail comprises a steel rail.

It is a further feature of the invention that the mullion rail comprises a rollformed steel rail.

It is an additional feature of the invention that the cabinet includes a door having a magnetic door gasket seal for sealing against the mullion rail front wall and wherein the formed portion is positioned so that the conduit is retained laterally spaced relative to the seal.

It is an additional feature of the invention that the cabinet comprises a body of foamed-in-place insulation in the cabinet between the shell and the liners and the insulation at least partially fills the first and second mullion rail channels to provide insulation and add structural stability.

In accordance with another aspect of the invention, an improved mullion assembly comprises an elongate heated gas tube carrying heated refrigeration gas for preventing condensation. A mullion rail comprises an elongate plate defining a centerline and opposite first and second longitudinal edges. The plate has opposite first and second reverse bends between the centerline and the first and second longitudinal edges, respectively, to define facing first and second channels. Third and fourth reverse bends are formed between the first and second reverse bends and the first and second longitudinal edges, respectively, to define third and fourth oppositely opening channels. The third and fourth channel openings each receives the one flange of one of the liners. The plate includes a rounded curved portion between the first and third reverse bends and spaced a select distance from a front wall rear surface less than a thickness of a tube to positively retain the tube in the first channel in surface contact with the front wall rear surface to prevent condensation on the mullion rail.

It is a further feature of the invention that each of the channels comprises a generally U-shaped channel.

Further features and advantages of the invention will be readily apparent from the specification and from the drawing.

DETAILED DESCRIPTION OF THE INVENTION

Figure 1:
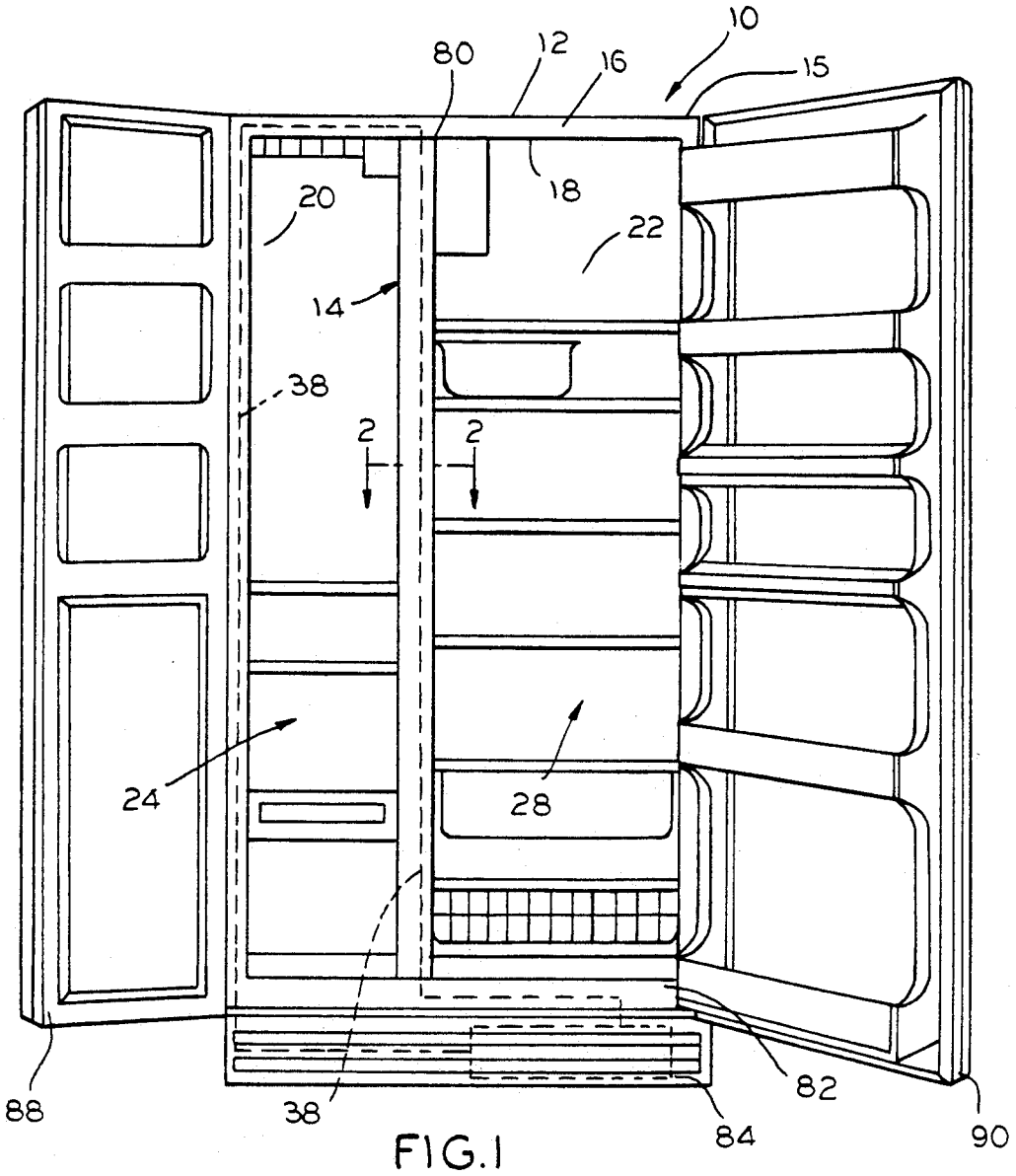
FIG. 1 is a front elevation view of a refrigeration apparatus including the improved mullion assembly according to the invention.

Referring to FIG. 1, a refrigeration apparatus, such as a refrigerator/freezer 10, includes a cabinet 12 according to the invention adapted to include an improved mullion assembly 14. The invention is shown utilized with a side-by-side refrigerator/freezer; however, other types of refrigeration apparatus may be used in conjunction with the improved mullion assembly of the invention, as will be obvious to those skilled in the art.

The cabinet 12 comprises a pre-painted steel shell 15 in a generally parallelepiped configuration having an inwardly turned front flange or wall surface 16 defining a rectangular opening 18. The shell 15 houses first and second thermoformed plastic liners 20 and 22 each in the configuration of a tub. The first liner 20 defines a freezer compartment and is surrounded by a peripheral, generally rectangular flange 26 extending outwardly therefrom, see FIG. 2. The second liner 22 defines a refrigerator compartment 28 and is also surrounded by a peripheral, generally rectangular outwardly directed flange 30, see FIG. 2. The first liner 20 and second liner 22 are positioned in side-by-side juxtaposed relation in the shell 15. A side edge 32 of the freezer liner flange 26 is adjacent to and extends parallel to a corresponding side edge 34 of the refrigerator liner flange 30, as particularly illustrated in FIG. 2. Although not specifically shown, the three remaining edges of each liner 20 and 22 are captured in channels provided in the shell flange 16.

The mullion assembly 14 is adapted to capture and retain the liner flange edges 32 and 34 to properly position the liners 20 and 22 relative to one another within the shell 15. The mullion assembly 14 comprises a mullion rail 36 and a hot gas tube 38 for preventing buildup of condensation on the mullion rail 36, as discussed more specifically below.

Figure 3:
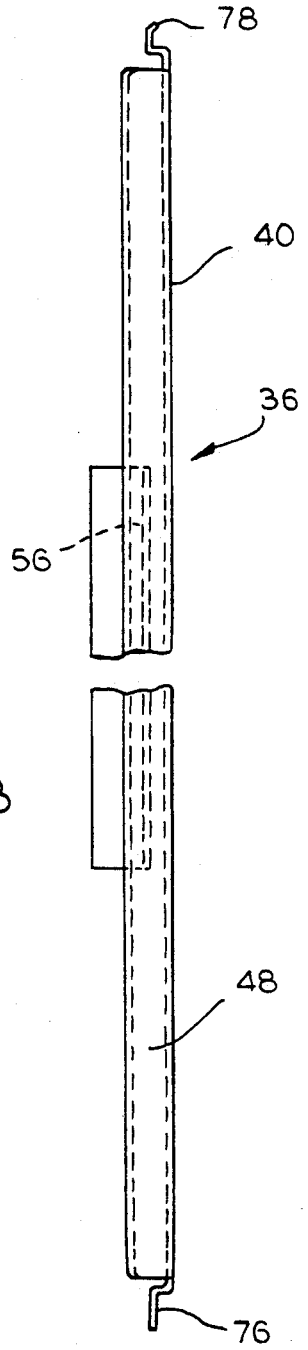
FIG. 3 is a partial side view of the mullion rail of the refrigeration apparatus of FIG. 1.
Figure 4:
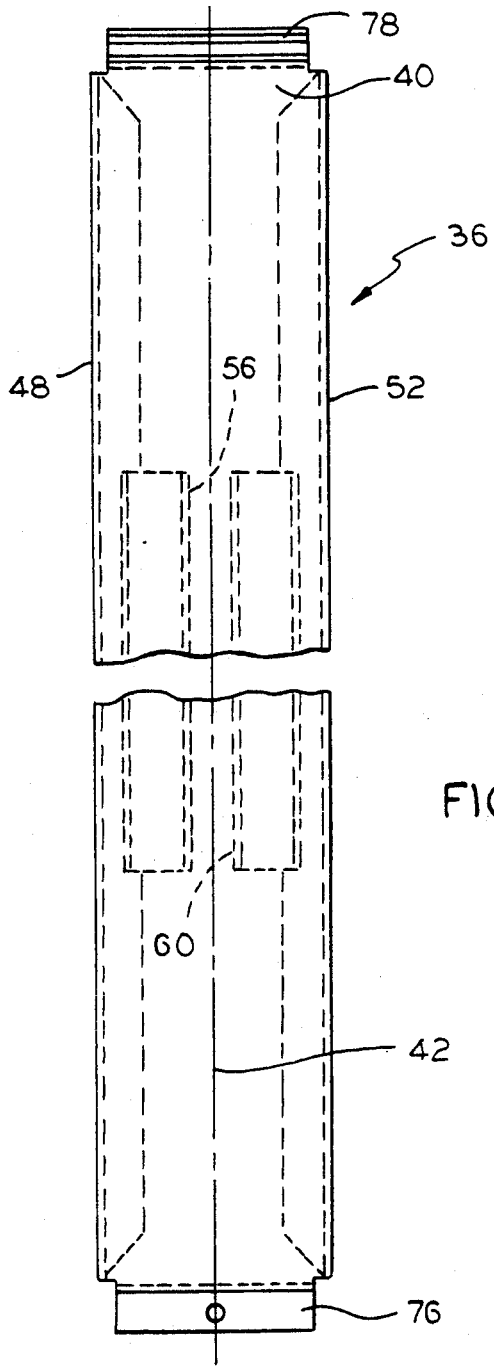
FIG. 4 is a partial, front elevation view of the mullion rail of FIG. 3.
Figure 5:
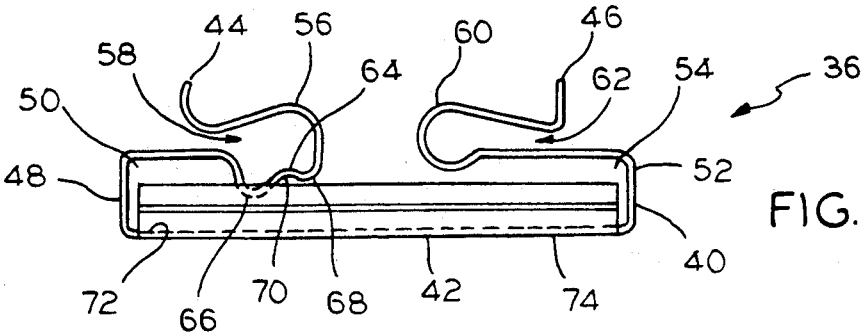
FIG. 5 is a top plan view of the mullion rail of FIG. 4.

With reference also to FIGS. 3-5, the mullion rail comprises an elongate plate 40 of pre-painted steel. The plate 40 is rollformed to provide suitable channels to support the liner flanges 26 and 30 and retain the hot gas tube 38.

The elongate plate 40 in its unformed state defines a centerline represented by a line 42, see FIG. 4, between opposite first and second longitudinal edges 44 and 46, see FIG. 5. The plate 40 has a first reverse bend 48 between the centerline 42 and the first longitudinal edge 44 to define a first, generally U-shaped channel 50. A second reverse bend 52 is formed opposite the first reverse bend 48 between the centerline 42 and the second longitudinal edge 46 to define a second, generally U-shaped channel 54. The first channel 50 and second channel 54 open in a direction facing one another, as illustrated. A third reverse bend 56 is formed between the first reverse bend 48 and the first longitudinal edge 44 to define a third, generally U-shaped channel 58 opening in a direction opposite the first channel 50. A fourth reverse bend 60 is formed opposite the third reverse bend 56 between the second reverse bend 52 and the second longitudinal edge 46 to define a fourth, generally U-shaped channel 62 opening in a direction opposite both the second channel 54 and the third channel 58. As shown, the third and fourth channels 58 and 62 to not extend the full vertical height of the plate 40.

Figure 2:
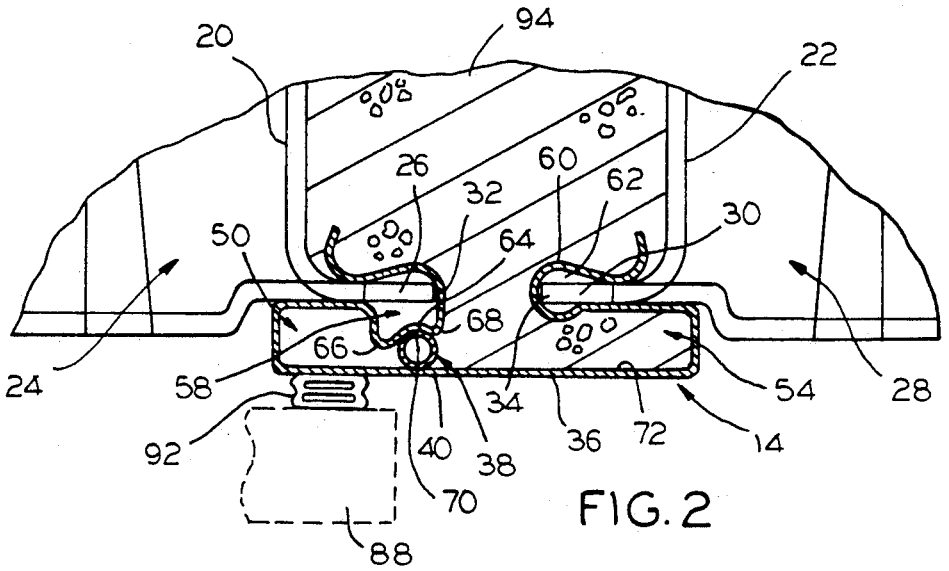
FIG. 2 is a sectional view taken along the line 2—2 of FIG. 1.

As illustrated in FIG. 2, the third channel 58 receives the freezer liner flange 26 proximate the side edge 32. The fourth channel 62 receives the refrigerator liner flange 30 proximate the side edge 34 to properly position the liners 20 and 22 relative to one another.

In order to retain the hot gas tube 38, the plate 40 includes a formed portion 64 between the first reverse bend 48 and the third reverse bend 56. Particularly, the formed portion 64 includes adjacent reverse bends 66 and 68 to define a rounded curved portion 70 therebetween. The rounded curved portion 70 is spaced from a rear surface 72 of a front wall 74 of the plate 40 less than a diameter of the hot gas tube 38 which is circular in cross section. Particularly, the curved portion 70 is a portion of a circular arc complementary to the tube 38.

In accordance with the invention, the curved portion 70 could be any necessary shape according to the shape of the tube 38.

The mullion rail 36 is additionally provided with a flat bottom tab 76 and a curved top tab 78, see FIGS. 3 and 4, to tuck under the cabinet flange 16 at a top portion 80 and a bottom deck rail cover 82, see FIG. 1. These tabs 76 and 78 serve to position the rail 36 within the cabinet 12 and maintain a small functional gap at the bottom between the mullion rail 36 and the deck rail cover 82.

As is conventional, the freezer and fresh food compartments 20 and 22 are cooled by circulating air therethrough which has been refrigerated as a result of being passed in heat exchange relation with a conventional evaporator (not shown). In addition to the evaporator, the refrigerator/freezer 10 includes connected components illustrated schematically at 84, to provide a sealed refrigeration system, including a compressor and a condenser. As is known, the condenser includes a hot gas loop formed by a conduit or tube. As high pressure refrigerant flows through the condenser, the high pressure causes vapor to condense back to liquid refrigerant, which gives out heat. The condenser includes a hot gas tube 38 connected to the sealed system 84 and surrounding the freezer compartment 24 to prevent condensation on the exposed front metal surfaces adjacent the liner flange 26. The tube 38 is snap-fit into the curved portion 64 within the first channel 50. Particularly, the relatively close spacing between the rounded curve portion 70 and the front wall rear surface 72 provides a snap-fit retention of the tube 38 in surface contact with the front wall rear surface 72.

The cabinet 12 includes a freezer door 88 for selective access to the freezer compartment 24. A refrigerator door 90 provides selective access to the refrigerator compartment 28. Each door 88 and 90 includes a peripheral magnetic door gasket seal. A portion of a gasket seal 92 for the freezer door 88 is illustrated in FIG. 2. In accordance with the invention, the mullion rail formed portion 64 retains the tube 38 so that the tube 38 is retained laterally spaced relative to the seal 92.

During manufacturing, the cabinet 12 is foamed-in-place to include a body of insulation 94 surrounding the liners 20 and 22 within the shell 15. The body of insulation 94 also fills the space between the juxtaposed liners 20 and 22, as shown in FIG. 2. The design of the mullion rail 36 allows the insulation 94 to partially fill the rail 36, particularly the second channel 54 and the first channel 50, up to the tube 38, adding both insulation and structural stability to the mullion rail assembly 14.

In the illustrated embodiment of the invention, the tube 38 is positioned in proximity to the freezer side of the mullion rail 36. However, the design could be altered so that the tube 38 is positioned closer to the refrigerator compartment 28.

Thus, in accordance with the invention, the mullion rail assembly 14 provides a snap-fit retention of the hot gas loop tube 38 within the mullion rail first channel 50 so that it is in surface contact with the front wall rear surface 72 to provide effective heat transfer from the tube 38 to the steel along the entire length of the mullion rail 36. This design provides economies to the end user by eliminating an electrical heater, which requires energy to run the same, and to the manufacturer by reducing assembly labor and part counts relative to securing the tube 38 within the mullion rail 36.

The foregoing disclosure of the invention is illustrative of the broad inventive concepts comprehended by the invention.

We claim:

1. In a refrigeration apparatus cabinet including an outer shell having a front flange defining a rectangular opening, first and second liners in juxtaposed relation in said shell defining first and second storage compartments, respectively, each side liner including a generally rectangular, front peripheral flange with one side edge of each flange being adjacent one another, an improved heated mullion assembly, comprising:

an elongate conduit, said conduit carrying heating means for preventing condensation; and a mullion rail comprising an elongate plate defining a centerline and opposite first and second longitudinal edges, said plate having a first reverse bend between said centerline and said first longitudinal edge to define a first channel, a second reverse bend between said centerline and said second longitudinal edge to define a second channel opening in a direction facing the first channel, a third reverse bend between said first reverse bend and said first longitudinal edge to define a third channel opening opposite the first channel, and a fourth reverse bend between said second reverse bend and said second longitudinal edge to define a fourth channel opening opposite the third channel, said third and fourth channels each receiving the one flange of one said liner, and said plate including a formed portion between said first and third reverse bends adapted to provide a surface complementary to said conduit and spaced a select distance from a front wall rear surface less than a thickness of said conduit to positively retain said conduit in said first channel in surface contact with said front wall rear surface to prevent condensation on said mullion rail.

2. The improved mullion assembly of claim 1 wherein said conduit comprises a tube and said heating means comprises a hot refrigerated gas circulated therethrough.

3. The improved mullion assembly of claim 1 wherein said mullion rail comprises a steel rail.

4. The improved mullion assembly of claim 1 wherein said mullion rail comprises a rollformed steel rail.

5. The improved mullion assembly of claim 1 wherein said cabinet includes a door having a magnetic door gasket seal for sealing against said mullion rail front wall and wherein said formed portion is positioned so that said conduit is retained laterally spaced relative to said seal.

6. The improved mullion assembly of claim 1 further comprising a body of foamed-in-place insulation in said cabinet between said shell and said liners, said insulation at least partially filling said first and second mullion rail channels to provide insulation and add structural stability.

7. In a refrigeration apparatus cabinet including an outer shell having a front flange defining a rectangular opening, first and second liners in juxtaposed relation in said shell defining first and second storage compartments, respectively, each said liner including a generally rectangular, front peripheral flange with one side edge of each flange being adjacent one another, an improved mullion assembly comprising:

an elongate hot gas tube carrying heated refrigeration gas for preventing condensation; and a mullion rail comprising an elongate plate defining a centerline and opposite first and second longitudinal edges, said plate having opposite first and second reverse bends between said centerline and said first and second longitudinal edges, respectively, to define facing first and second channels, and third and fourth reverse bends between said first and second reverse bends and said first and second longitudinal edges, respectively, to define third and fourth oppositely opening channels, said third and fourth channel openings each receiving the one flange of one said liner, and said plate including a rounded curved portion between said first and third reverse bends and spaced a select distance from a front wall rear surface less than a thickness of said tube to positively retain said tube in said first channel in surface contact with said front wall rear surface to prevent condensation on said mullion rail.

8. The improved mullion assembly of claim 7 wherein said mullion rail comprises a steel rail.

9. The improved mullion assembly of claim 7 wherein said mullion rail comprises a rollformed steel rail.

10. The improved mullion assembly of claim 7 wherein said cabinet includes a door having a magnetic door gasket seal for sealing against said mullion rail front wall and wherein said rounded curve portion is positioned so that said conduit is retained laterally spaced relative to said seal.

11. The improved mullion assembly of claim 7 further comprising a body of foamed-in-place insulation in said cabinet between said shell and said liners, said insulation at least partially filling said first and second mullion rail channels to provide insulation and add structural stability.

12. The improved mullion assembly of claim 7 wherein each said channel comprises a generally U-shaped channel.

* * * * *